US008708757B2

(12) United States Patent
Trout et al.

(10) Patent No.: US 8,708,757 B2
(45) Date of Patent: Apr. 29, 2014

(54) ELECTRICAL CONTACT CONFIGURED TO IMPEDE CAPILLARY FLOW DURING PLATING

(75) Inventors: David Allison Trout, Lancaster, PA (US); James Charles Shiffler, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 64 days.

(21) Appl. No.: 13/270,948

(22) Filed: Oct. 11, 2011

(65) Prior Publication Data

US 2013/0090025 A1 Apr. 11, 2013

(51) Int. Cl.
*H01R 13/40* (2006.01)

(52) U.S. Cl.
USPC ..... 439/733.1; 439/751; 439/886

(58) Field of Classification Search
USPC ..... 439/751, 78, 84, 886, 82, 733.1
See application file for complete search history.

(56) References Cited

U.S. PATENT DOCUMENTS 5,399,108 A * 3/1995 Lu et al. ..... 439/682
5,618,187 A * 4/1997 Goto ..... 439/79
5,692,920 A 12/1997 Banakis et al.
5,788,539 A 8/1998 Fedder
5,934,951 A 8/1999 Lai et al.
5,957,736 A * 9/1999 Moriuchi et al. ..... 439/876
6,241,535 B1 6/2001 Lemke et al.
6,290,555 B1 9/2001 Nubuyuki et al.
6,848,952 B2 * 2/2005 Norris ..... 439/751
6,997,727 B1 2/2006 Legrady et al.
7,080,451 B2 * 7/2006 Saito et al. ..... 29/874
7,172,438 B2 2/2007 Vicich et al.
7,637,777 B1 12/2009 Trout et al.
7,641,523 B2 * 1/2010 Chen ..... 439/825
7,736,183 B2 6/2010 Trout et al.
7,744,431 B2 * 6/2010 Trout et al. ..... 439/733.1
7,867,016 B2 1/2011 Nabilek et al.
8,277,240 B2 * 10/2012 Urano ..... 439/232

OTHER PUBLICATIONS

Receptacle Assembly 80/259 Signal Strada Mesa Mezzanine Connector; C-2057361, 3 pgs.

* cited by examiner

*Primary Examiner* — Hien Vu

(57) ABSTRACT

An electrical contact including an elongated contact body that has a compliant tail, a mating beam, and a channel section extending between the compliant tail and the mating beam. The channel section has a base wall and sidewalls that extend from the base wall. The base wall and the sidewalls extend around a central longitudinal axis to define a flow channel. The channel section includes a flow-limiting feature that is configured to impede capillary flow of a plating solution along the channel section from the compliant tail to the mating beam.

17 Claims, 6 Drawing Sheets

ELECTRICAL CONTACT CONFIGURED TO IMPEDE CAPILLARY FLOW DURING PLATING

BACKGROUND OF THE INVENTION

The subject matter described and/or illustrated herein relates generally to electrical contacts having plated portions and electrical connectors that use such contacts.

Electrical contacts can be plated with material that facilitates the electrical connection of the contacts with other contacts. For example, known electrical contacts include a compliant tail that is configured to be inserted into a plated thru-hole and also a mating beam that is configured to slide or wipe along a surface of a mating contact to electrically engage the mating contact to the electrical contact. The compliant tail may be plated with a material that is suitable for press-fit engagement with the plated thru-hole. The mating beam may be plated with a material that is suitable for the electrical connection between the mating beam and the mating contact. By way of one example, the mating beam can be plated with a gold material and the compliant tail can be plated with a tin or tin-lead material.

In some cases, during the manufacture of the electrical contacts, the bodies of the contacts may be susceptible to capillary action or wicking in which a solution travels along the surface of the contact body. For example, a solution of one material may travel along the surface of the contact body and react with a different material that was previously plated to the electrical contact. In such cases, unwanted intermetallic compounds may be formed that can negatively affect the electrical performance of the contact. The intermetallic compounds may also be susceptible to flaking in which the intermetallic compounds do not adhere to the contact body. Although different processes have been proposed to prevent the formation of intermetallic compounds, these processes may be, for example, cost-prohibitive, unsuitable for smaller dimensioned electrical contacts, and/or unsuitable for the desired type of electrical contact.

Accordingly, there is a need for electrical contacts that are configured to impede capillary action of plating solutions during the manufacture of electrical contacts.

BRIEF DESCRIPTION OF THE INVENTION

In one embodiment, an electrical contact is provided that includes an elongated contact body that has a compliant tail, a mating beam, and a channel section extending between the compliant tail and the mating beam. The channel section has a base wall and sidewalls that extend from the base wall. The base wall and the sidewalls extend around a central longitudinal axis to define a flow channel. The compliant tail extends from the base wall parallel to the longitudinal axis. The channel section includes a flow-limiting feature that is configured to impede capillary flow of a plating solution along the channel section from the compliant tail to the mating beam.

Optionally, the flow channel has an inlet and the channel section has at least one surface that extends from the inlet toward the mating beam. The flow-limiting feature is sized and located to disrupt a continuity of said at least one surface from the inlet to the mating beam. Optionally, the flow-limiting feature includes a folded tab portion that at least partially covers the inlet.

In another embodiment, an electrical connector is also provided that includes a connector housing having an array of contact cavities. The electrical connector also includes electrical contacts that are located in the contact cavities. At least a plurality of the electrical contacts include signal contacts. Each of the plurality of signal contacts includes an elongated contact body having a compliant tail, a mating beam, and a channel section that extends between the compliant tail and the mating beam. The channel section has a base wall and sidewalls that extend from the base wall. The base wall and the sidewalls extend around a central longitudinal axis to define a flow channel. The channel section includes a flow-limiting feature that is configured to impede capillary flow of a plating solution along the channel section from the compliant tail to the mating beam.

DETAILED DESCRIPTION OF THE INVENTION

Figure 1:
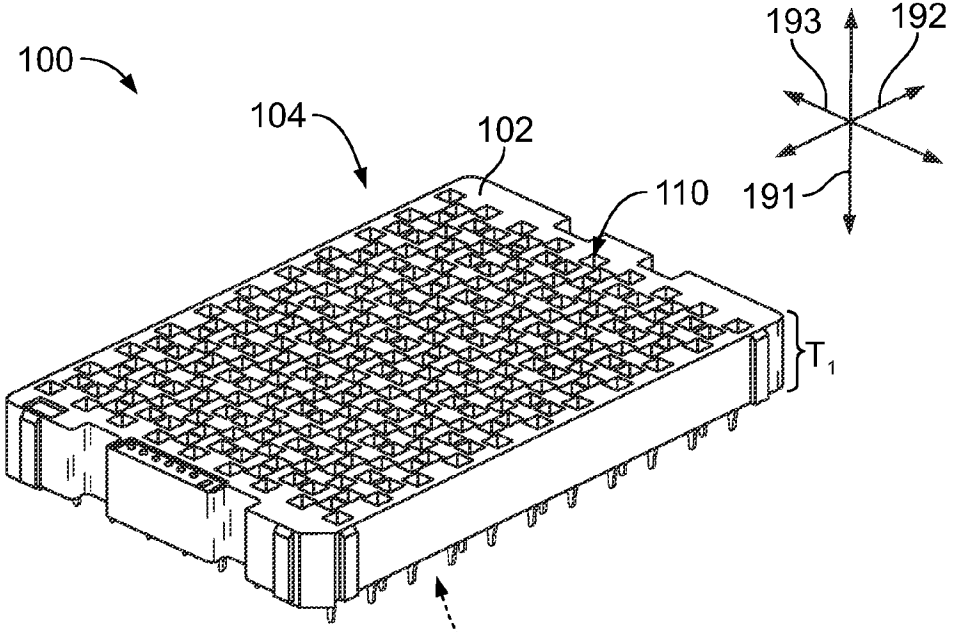
FIG. 1 is a perspective view of a mating side of an electrical connector formed in accordance with one embodiment.
Figure 2:
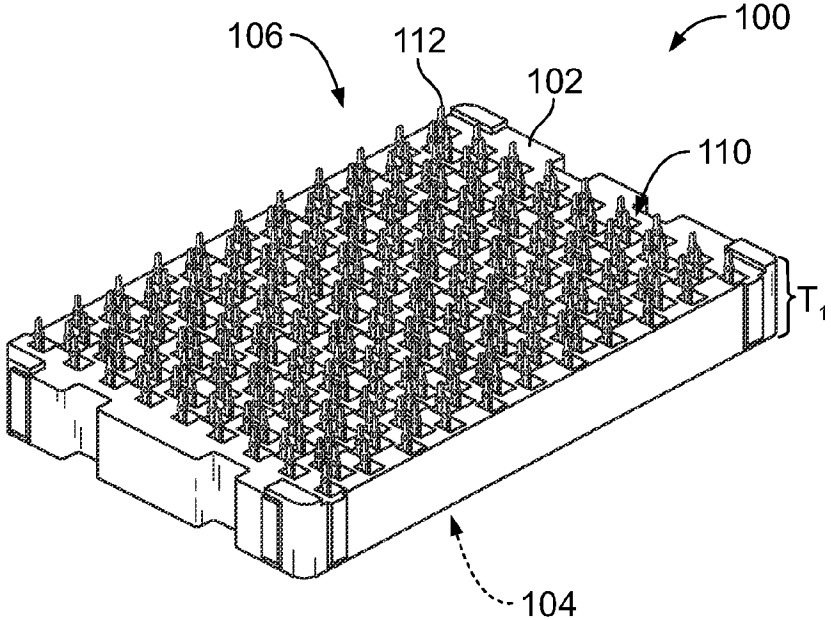
FIG. 2 is a perspective view of a mounting side of the electrical connector of FIG. 1.

FIGS. 1 and 2 illustrate different perspective views of an electrical connector 100. The electrical connector 100 is oriented with respect to mutually perpendicular axes 191-193 (FIG. 1) that include a mounting axis 191 and lateral axes 192, 193. In an exemplary embodiment, the electrical connector 100 has a connector housing 102 that includes a mating side 104 and a mounting side 106. The mating and mounting sides 104, 106 face in opposite directions along the mounting axis 191. In particular embodiments, the mating and mounting sides 104, 106 extend substantially parallel to each other and to the lateral axes 192, 193. The mating and mounting sides 104, 106 can define a thickness $T_1$ of the connector housing 102 therebetween.

As shown, the electrical connector 100 has an array of contact cavities 110 that extend through the connector housing 102. A plurality of electrical contacts 112 (FIG. 2) are located in the contact cavities 110. In the illustrated embodiment, each contact cavity 110 is sized and shaped to receive a single electrical contact 112. However, contact cavities 110 may receive more than one electrical contact in other embodiments. The contact cavities 110 extend along the mounting axis 191 through the connector housing 102. The electrical contacts 112 are configured to be inserted into the contact cavities 110 through the mating side 104. The electrical contacts 112 may frictionally engage the connector housing 102 to hold the electrical contacts 112 within the contact cavities 110.

In an exemplary embodiment, the electrical contacts 112 are signal contacts capable of transmitting data signals at high speeds. For example, in some embodiments, the electrical contacts 112 are suitable for transmitting data signals at 15 Gbs or more. In more particular embodiments, the electrical contacts 112 are suitable for transmitting data signals at 25 Gbs or more. The electrical contacts 112 include a plurality of differential pairs and can be located with respect to each other to reduce/cancel noise. In other embodiments, the electrical contacts 112 can be arranged in a row-and-column array. Although not shown, the electrical connector 100 may include other types of electrical contacts in addition to the electrical contacts 112. For example, the electrical connector 100 may include power contacts that are disposed in corresponding contact cavities.

In particular embodiments, the electrical connector 100 is a receptacle connector that is configured to engage a mating connector or header (not shown) in a mezzanine-type connector assembly. The header may be mounted onto the mating side 104. The header includes mating contacts (not shown) having corresponding contact tails or extensions that are configured to be inserted into the contact cavities 110 through the mating side 104 where the electrical contacts 112 and the mating contacts of the header are electrically engaged. Each of the header and the electrical connector 100 can be mounted and electrically engaged to a respective circuit board. When the header and the electrical connector 100 are electrically engaged, the circuit boards can extend parallel to one another. Exemplary connector assemblies include STRADA Mesa® mezzanine connector assemblies developed by Tyco Electronics Corporation. Although the above is one particular embodiment in which the electrical connector 100 and electrical contacts 112 are suitable, the electrical connectors and contacts described herein may be used in other types of connectors, assemblies, and systems.

Figure 4:
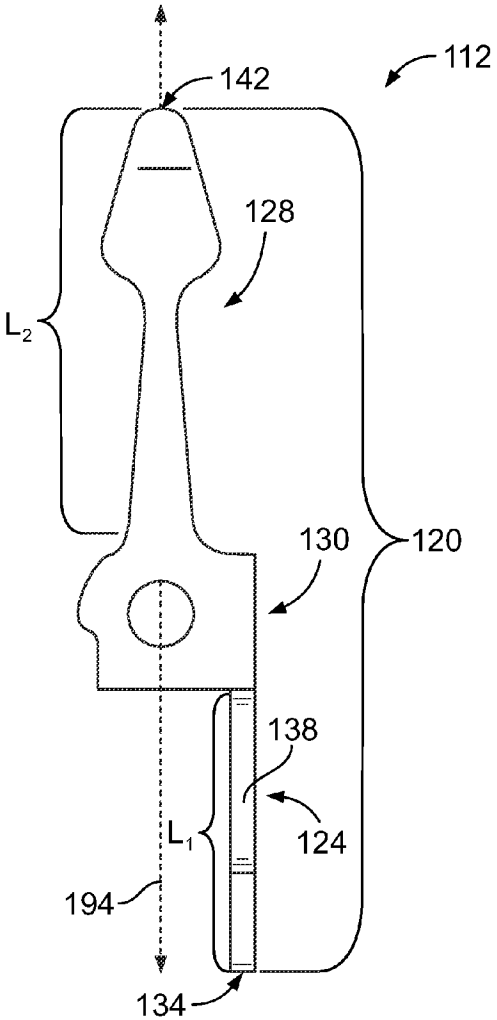
FIG. 4 is a side view of the electrical contact of FIG. 3.
Figure 3:
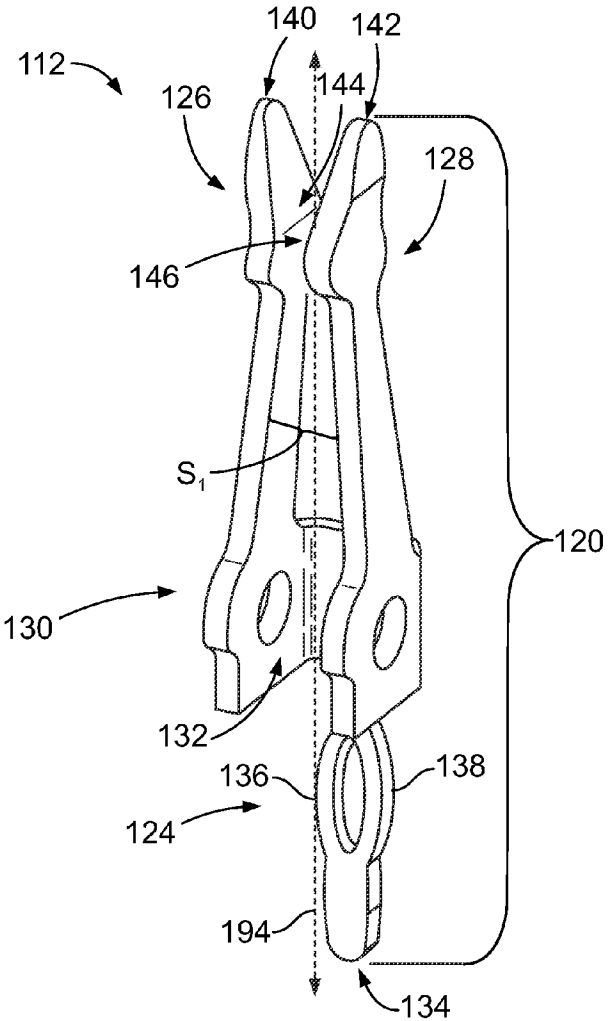
FIG. 3 is a perspective view of an electrical contact formed in accordance with one embodiment.

FIGS. 3 and 4 are perspective and side views, respectively, of the electrical contact 112. In an exemplary embodiment, the electrical contact 112 has an elongated contact body 120 that includes a compliant tail 124, a pair of mating beams 126 (FIG. 3), 128, and a channel section 130 that extends between and joins the compliant tail 124 and the mating beams 126, 128. As will be described in greater detail below, the channel section 130 defines a flow channel 132 (FIG. 3) that extends along the channel section 130 between the mating beams 126, 128 and the compliant tail 124. A central longitudinal axis 194 extends through the flow channel 132 along the contact body 120. In an exemplary embodiment, the compliant tail 124 and the mating beams 126, 128 extend substantially parallel to the longitudinal axis 194.

The compliant tail 124 has a length $L_1$ (FIG. 4) that extends from the channel section 130 to a distal end 134. The compliant tail 124 is configured to electrically connect with a component (not shown), such as a circuit board. For example, the compliant tail 124 may be configured to be inserted into a plated via or thru-hole of a circuit board and frictionally and electrically engage the plated via or thru-hole. In particular embodiments, the compliant tail 124 is an eye-of-needle type tail having a pair of opposing rib portions 136 (FIG. 3), 138. When the compliant tail 124 is inserted into the plated via or thru-hole, the rib portions 136, 138 can be deflected toward each other. However, in other embodiments, the compliant tail 124 may be other types of contact extensions, such as a pin that does not include the rib portions 136, 138.

The mating beams 126, 128 extend a length $L_2$ (FIG. 4) from the channel section 130 to respective distal ends 140 (FIG. 3), 142. In some embodiments, the mating beams 126, 128 face each other and have a spacing $S_1$ (FIG. 3) therebetween. The spacing $S_1$ is sized to receive a contact extension from a mating contact. In the illustrated embodiment, the mating beams 126, 128 extend away from the channel section 130 at an angle such that the mating beams 126, 128 are inclined toward each other. More specifically, as the mating beams 126, 128 extend toward the respective distal ends 140, 142, the spacing $S_1$ becomes smaller. As shown in FIG. 3, the mating beams 126, 128 include respective distal mating areas 144, 146 that are configured to slide along and electrically engage the contact extension. In particular embodiments, the mating areas 144, 146 include a plating material thereon.

When the contact extension is inserted into the spacing $S_1$, the mating areas 144, 146 of the mating beams 126, 128, respectively, slidably engage the contact extension and are deflected away from each other. The mating beams 126, 128 are biased such that the mating beams 126, 128 resist deflection away from each other. When the contact extension is located between and electrically engaged to the mating beams 126, 128, the mating beams 126, 128 provide respective biasing forces toward each other that facilitate maintaining the electrical connection.

In the illustrated embodiment, the compliant tail 124 extends parallel to the longitudinal axis 194. The mating beams 126, 128 project in a direction that is generally opposite from the direction of the compliant tail and also extend generally parallel to the longitudinal axis 194. The compliant tail 124 and the mating beams 126, 128 may extend substantially parallel to the longitudinal axis 194 for substantially the entire lengths $L_1$ and $L_2$ as shown in FIGS. 3 and 4. However, in other embodiments, only a portion of the compliant tail 124 and/or the mating beams 126, 128 extend parallel to the longitudinal axis 194.

In some embodiments, the electrical contact 112 may be stamped from a layer of sheet metal and formed to a particular shape. Before or after stamping and forming the electrical contact 112, the electrical contact 112 may be plated or coated with one or more plating materials. By way of example only, after the electrical contacts 112 are stamped and formed, the electrical contacts 112 may be plated with a base material, such as a material including nickel (e.g., nickel alloy). The base material may substantially cover an entirety of the electrical contact 112 or only a portion(s) of the electrical contact 112. The plating process may be an electroplating process in which metal ions in the plating solution are moved by an electric field to coat an electrode, i.e., the electrical contact.

After plating or coating the electrical contacts 112 with the base material, the mating beams 126, 128 may be plated with a first plating material, such as a material including gold (e.g., gold alloy). The first plating material may be a charged (e.g., polar) solution and plated onto the base material using an electroplating process. Before or after the mating beams 126, 128 are plated, the compliant tail 124 may be plated with a second plating material, such as a material including tin (e.g., tin alloy). The second plating material may be a charged (e.g., polar) solution. The compliant tails 124 are dipped into the second plating material and another electroplating process may be applied. When the compliant tails 124 are dipped into the plating solution of the second plating material, the longitudinal axes 194 of the electrical contacts 112 may extend substantially parallel to a gravitational pull axis. The channel section 130 may be located immediately adjacent to or at least partially contact a surface of the plating solution. Although the above describes one possible method of plating the electrical contact 112, other processes and/or modified versions of the above process can be used.

During the plating of electrical contacts, it is known that a plating solution (e.g., a charged solution including water and metallic ions) can move or flow along the surfaces of the electrical contact against the force of gravity. This movement may especially occur along electrical contacts that define a channel that is susceptible to capillary flow. In some cases, this movement may be undesirable because the plating solution may be plated in an unwanted location or may interact with a material that is already plated on the electrical contact. In either case, intermetallic compounds can be formed that negatively affect the electrical performance of the electrical contact.

Flow of the plating solution against the force of gravity may be caused by capillary action (capillary flow or wicking). For example, the plating solution may experience various forces along the surface of the electrical contact that could result in moving the plating solution therealong. These forces may include cohesive forces (i.e., attractive forces between like molecules of the plating solution) and adhesive forces (i.e., attractive forces between molecules of the plating solution and a solid surface or vapor that surrounds the plating solution). Cohesive and adhesive forces arise from the interaction of atoms and molecules that are located along, for example, a liquid-vapor interface and a liquid-solid interface. The cohesive and adhesive forces act to lift the plating solution against the force of gravity and move the plating solution through the channel.

The electrical contacts may be susceptible to capillary flow of the plating solution based on various factors, such as the dimensions of the flow channel, the chemical composition of the plating solution, the purity of the plating solution, and whether a surfactant is used. These factors can affect the surface tension of the plating solution and the molecular interactions along the solid-liquid interface. The electrical contact may also have a surface energy that is conducive for wetting by the plating solution. Also, a purity of the solid or whether a coating is placed on the solid surface may affect the surface energy of the solid surface.

Embodiments described herein include one or more flow-limiting features that are configured to prevent or inhibit (e.g., at least substantially reduce or limit) the capillary action of the plating solution during the plating process. The flow-limiting features include at least structural features of the electrical contact, such as voids, projections, folded portions, and the like. The flow-limiting feature(s) can be sized, shaped, and located in order to impede the capillary flow of the plating solution. In some embodiments, the flow-limiting features can include surface modifications. For example, the surfaces can be roughened or have a chemical coating deposited thereon.

The flow-limiting features can effectively impede the plating solution from wetting undesirable portions of the electrical contacts and from inadvertently depositing metal ions along the undesirable portions (e.g., the mating beams). In some embodiments, the flow-limiting features may disrupt a continuity of at least one surface of the channel section that is susceptible to capillary action. In some embodiments, the flow-limiting features may limit an amount of plating solution that enters the flow channel.

Figure 5:
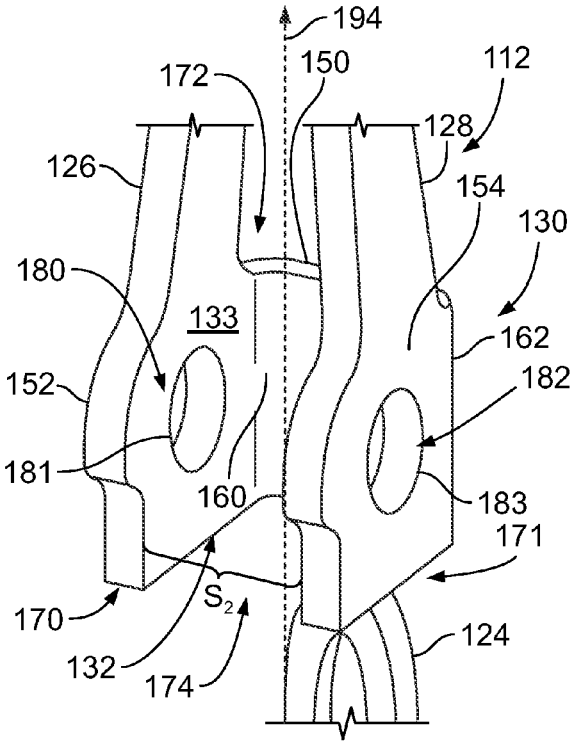
FIG. 5 is an enlarged perspective view of a portion of the electrical contact of FIG. 3.
Figure 6:
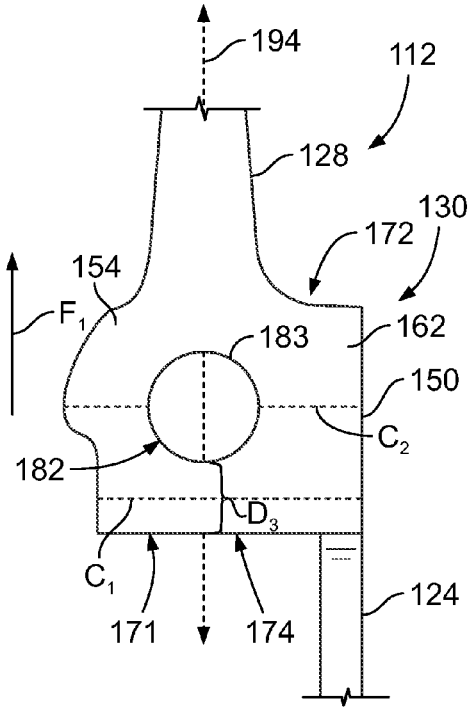
FIG. 6 is an enlarged side view of a portion of the electrical contact of FIG. 3.

FIGS. 5 and 6 illustrate enlarged perspective and side views of the electrical contact 112 and, more particularly, the channel section 130. As shown, the channel section 130 has a base wall 150 and sidewalls 152 (FIG. 5), 154 that project away from the base wall 150. The base wall 150 and the sidewalls 152, 154 extend around the longitudinal axis 194 to define the flow channel 132 (FIG. 5). In some embodiments, the sidewalls 152, 154 may face each other across the flow channel 132. The flow channel 132 is defined by a channel surface 133 (FIG. 5) that extends along the base wall 150 and the sidewalls 152, 154 and around the longitudinal axis 194.

The channel section 130 may include wall edges 170 (FIG. 5), 171 and a base edge 172. The base edge 172 faces in an opposite direction along the longitudinal axis 194 with respect to the wall edges 170, 171. The mating beams 126 (FIG. 5), 128 project away from the base edge 172 generally along the longitudinal axis 194. The compliant tail 124 projects away from the wall edges 170, 171 generally along the longitudinal axis 194. Also shown, the channel section 130 has an inlet 174 that provides access to the flow channel 132. The inlet 174 may be configured to receive a plating solution when the electrical contact 112 undergoes a plating process.

In some embodiments, the channel section 130 may be boxed or rectangular-shaped in which adjacent sides are perpendicular to each other. For example, the base wall 150 and the sidewall 152 are adjacent to each other and are coupled along a fold line 160 (FIG. 5). The base wall 150 and the sidewall 154 are adjacent to each other and are coupled along a fold line 162. The fold lines 160, 162 may extend parallel to the longitudinal axis 194. In the illustrated embodiment, the base wall 150 and the sidewalls 152, 154 are substantially planar. However, in other embodiment, the base wall 150, the sidewall 152, and/or the sidewall 154 may have curved contours.

In particular embodiments, the channel section 130 does not completely surround the longitudinal axis 194. As shown in FIG. 5, a channel spacing $S_2$ may separate the sidewalls 152, 154 and extend throughout the channel section 130 along the longitudinal axis 194. As such, the channel section 130 and the flow channel 132 may be characterized as being open-sided. In the illustrated embodiment, the channel spacing $S_2$ between the sidewalls 152, 154 is substantially uniform from the wall edges 170, 171 to the mating beams 126, 128. In alternative embodiments, the channel spacing $S_2$ may increase or decrease.

However, in other embodiments, the channel section 130 nearly or completely surrounds the longitudinal axis 194. For example, the channel section 130 may have one or more walls in addition to the base wall 150 and the sidewalls 152, 154. The additional wall(s), the base wall 150, and the sidewalls 152, 154 may extend around the longitudinal axis 194 to define the flow channel 132 in a similar manner as described above. The additional wall(s), the base wall 150, the sidewalls 152, 154 can be part of the same sheet of material and the walls could be folded around the longitudinal axis 194. By way of one example only, one additional wall may be coupled to the sidewall 152 and folded along a fold line such that an edge of the additional wall is touching or nearly touching the sidewall 154. In such alternative embodiments, the channel section 130 can be four-sided such that the channel section 130 has a rectangle or square cross-section taken along the longitudinal axis 194 or the channel section 130 may be five-sided, six-sided or more.

The channel section 130 near the inlet 174 may be susceptible to capillary action in which a plating solution flows through the inlet 174 and into the flow channel 132. The plating solution may be configured to move in a flow direction as indicated by the arrow $F_1$ in FIG. 6. The flow direction $F_1$ may extend parallel to the longitudinal axis 194. More specifically, when the compliant tail 124 is deposited into a plating solution, capillary flow may move the plating solution along the channel surface 133 in the flow direction $F_1$ toward the mating beams 126, 128. In other embodiments, the flow direction $F_1$ may extend generally along but not parallel to the longitudinal axis 194.

Accordingly, the channel section 130 may include flow-limiting features 180 (FIG. 5), 182 that are configured to impede the plating solution from flowing onto the mating beams 126, 128. More specifically, the flow-limiting features 180, 182 are sized, shaped, and located along the sidewalls 152, 154 to impede or prevent capillary action of the plating solution through the flow channel 132 and onto the mating beams 126, 128. In particular embodiments, the flow-limiting features 180, 182 may be centrally located within the sidewalls 152, 154 as shown in FIGS. 5 and 6. In the illustrated embodiment, the flow-limiting features 180, 182 are voids 181 (FIG. 5), 183, respectively, that extend entirely through the sidewalls 152, 154, respectively.

However, in other embodiments, the base wall 150 may include a flow-limiting feature(s) instead of the sidewalls 152, 154 or, alternatively, each of the base wall 150 and the sidewalls 152, 154 may include a flow-limiting feature. In other embodiments, other types of flow-limiting features, such as the flow-limiting features 280, 282 shown in FIG. 10 and the flow-limiting features 380, 382 shown in FIG. 12, may be used alternatively or in addition to the voids 181, 183 shown in FIGS. 5 and 6.

Figure 7:
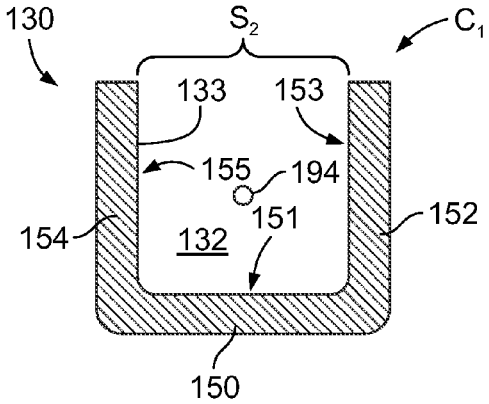
FIG. 7 illustrates a cross-section of the electrical contact of FIG. 3.
Figure 8:
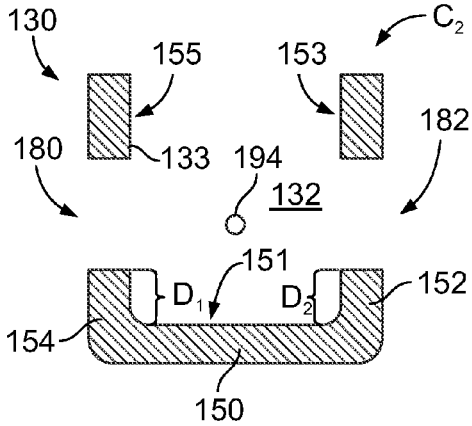
FIG. 8 illustrates another cross-section of the electrical contact of FIG. 3.

FIGS. 7 and 8 illustrate separate cross-sections $C_1$ and $C_2$ of the channel section 130 taken perpendicular to the longitudinal axis 194. With reference to FIG. 6, the cross-section $C_1$ is taken near the inlet 174 and is representative of the channel section 130 that is exposed to the plating solution and susceptible to permitting capillary action. The cross-section $C_2$ is taken through the flow-limiting features 180, 182. As shown in FIGS. 7 and 8, the channel surface 133 may comprise a plurality of interior surfaces including a base surface 151 of the base wall 150 and side surfaces 153, 155 of the sidewalls 152, 154, respectively.

With respect to FIG. 7, the channel surface 133 at the cross-section $C_1$ may have qualities or attributes that render the channel section 130 susceptible to capillary flow of a plating solution. For example, the side surface 153 may be continuously planar and smooth from the wall edge 170 (FIG. 5) to the flow-limiting features 180 (FIG. 5), and the side surface 155 may be continuously planar and smooth from the wall edge 171 (FIG. 5) to the flow-limiting features 182 (FIG. 5). The base surface 151 is continuously planar and smooth from the compliant tail 124 (FIG. 2) to the base edge 172 (FIG. 5). Various factors other than the continuity of the channel surface 133 may also affect the capillary flow of the plating solution. For example, a contour of the channel surface 133 at the cross-section $C_1$, a size of the spacing $S_2$, and wetting qualities of the channel surface 133 relative to the plating solution may also affect the capillary forces. In particular embodiments, the channel surface 133 at the cross-section $C_1$ is U-shaped and the size of the spacing $S_2$ is conducive for capillary flow. In other embodiments, the channel surface 133 may be C-shaped and have a spacing that is conducive for capillary flow.

In an exemplary embodiment, the flow-limiting features 180, 182 may be configured to disrupt the continuity of the channel surface 133 thereby impeding capillary flow of the plating solution to the mating beams 126, 128 (FIG. 3). As demonstrated in FIGS. 7 and 8, a total surface area of the channel surface 133 that the plating solution wets when flowing through the flow channel 132 is significantly smaller at the cross-section $C_2$. With the smaller surface area, the cohesive and adhesive forces are reduced and a weight of the plating solution may impede the capillary flow of the plating solution through the flow channel 132. In some cases, the plating solution may also spill through the flow-limiting features 180, 182.

As shown in FIG. 8, the flow-limiting features 180, 182 are located lateral distances $D_1$ and $D_2$, respectively, away from the base surface 151. As shown in FIG. 6, the flow-limiting features 180, 182 are located a longitudinal distance $D_3$ from the wall edges 170 (FIG. 5), 171. The lateral distances $D_1$ and $D_2$ and the longitudinal distance $D_3$ are configured to locate the flow-limiting features 180, 182 so that capillary flow through the flow channel 132 is impeded or prevented. In particular embodiments, the lateral distances $D_1$ and $D_2$ and the longitudinal distance $D_3$ are configured so that geometric centers of the sidewalls 152, 154 are located within the flow-limiting features 180, 182.

Figure 9:
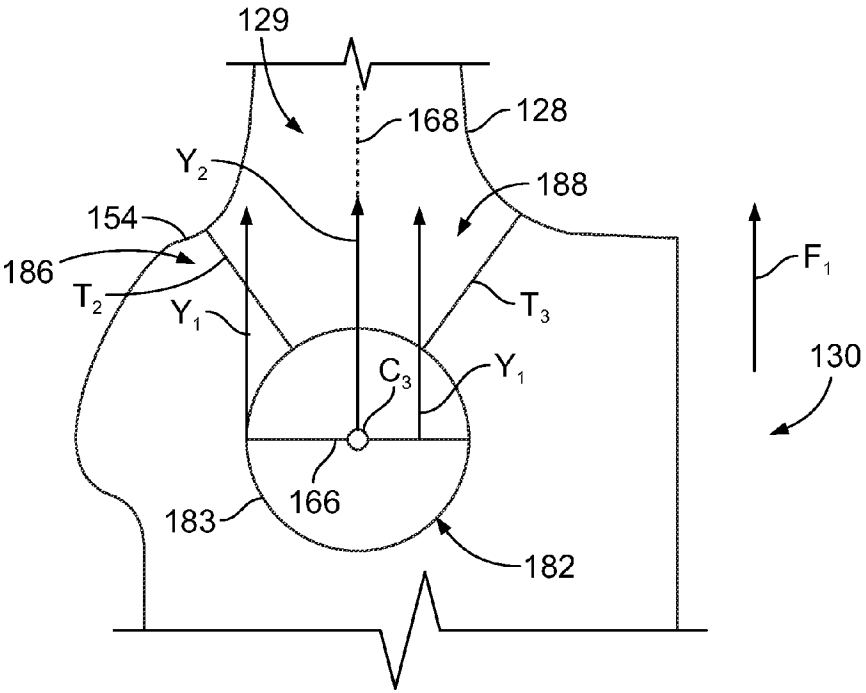
FIG. 9 is an enlarged side view of a sidewall of the electrical contact of FIG. 3.

FIG. 9 is an enlarged side view of the electrical contact 112 (FIG. 2) illustrating the sidewall 154 in greater detail. Although the following is described with particular reference to the flow-limiting feature 182, the description may be similarly applied to the flow-limiting feature 180. In some embodiments, the location of the flow-limiting feature 182 may facilitate impeding the plating solution from wetting the mating beam 128. The flow-limiting feature 182 may be located with respect to the flow direction $F_1$ such that the plating solution flowing toward the mating beam 128 would engage the flow-limiting feature 182. In other words, the flow-limiting feature 182 may be located such that the flow-limiting feature 182 is between the plating solution and the mating beam 128 during the plating process.

For example, the mating beam 128 includes a joint portion 129 that joins the mating beam 128 to the sidewall 154 of the channel section 130. The mating beam 128 may be configured to flex about the joint portion 129. In an exemplary embodiment, the flow-limiting feature 182 may be substantially aligned with the joint portion 129 such that plating solution flowing toward the mating beam 128 would engage the flow-limiting feature 182. More specifically, the flow-limiting feature 182 may have a diameter 166 taken perpendicular to the flow direction $F_1$ or the longitudinal axis 194 (FIG. 3). The diameter 166 represents a greatest width of the flow-limiting feature 182 when viewed along the longitudinal axis 194. In some embodiments, the flow-limiting feature 182 is substantially aligned with the mating beam 128 if a line $Y_1$ drawn parallel to the flow direction $F_1$ from any point along the diameter 166 extends into the joint portion 129 of the mating beam 128. However, in other embodiments, the flow-limiting feature 182 may still be substantially aligned with the mating beam 128 if more than 50% of the lines $Y_1$ drawn from the diameter 166 and parallel to the flow direction $F_1$ extend into the mating beam 128. More particularly, the flow-limiting feature 182 may be substantially aligned with the mating beam 128 if more than 75% or, even more particularly, 90% of the lines $Y_1$ drawn from the diameter 166 extend into the mating beam 128.

As another example, the flow-limiting feature 182 may be substantially aligned with the mating beam 128 if a line $Y_2$ drawn from a center $C_3$ of the flow-limiting feature 182 and parallel to the flow direction $F_1$ extends into the joint portion 129. In more particular embodiments, the line $Y_2$ may substantially coincide with a centerline 168 of the joint portion 129 or the mating beam 128 if the centerline 168 were extended further into the sidewall 154.

In the illustrated embodiment, the flow-limiting feature 182 includes a circular void 183. However, the flow-limiting feature 182 may be a void having other shapes in alternative embodiments (e.g., rectangle, diamond, octagon, other polygons, and the like). In such cases, a diameter (or greatest width) may be taken perpendicular to the flow direction $F_1$ or the longitudinal axis 194 and lines $Y_1$ may be drawn therefrom to determine if the flow-limiting feature is substantially aligned. In a similar manner, the flow-limiting features 280 and 282 (FIG. 10) described below may also be substantially aligned with the corresponding mating beams.

Also shown in FIG. 9, the flow-limiting feature 182 may be configured such that the electrical contact 112 (FIG. 2) achieves the desired electrical and mechanical performance. For example, the flow-limiting feature 182 may be sized, shaped, and located such that support portions 186, 188 exist within the sidewall 154. The support portions 186, 188 may be sized so that the mating beam 128 is suitable for flexing back and forth and for allowing a predetermined amount of current to flow therethrough. More specifically, the support portions 186, 188 may have a least cross-sectional area $T_2$, $T_3$, respectively. The least cross-sectional areas $T_2$, $T_3$ may be dimensioned to achieve the desired mechanical and electrical performance.

Figure 10:
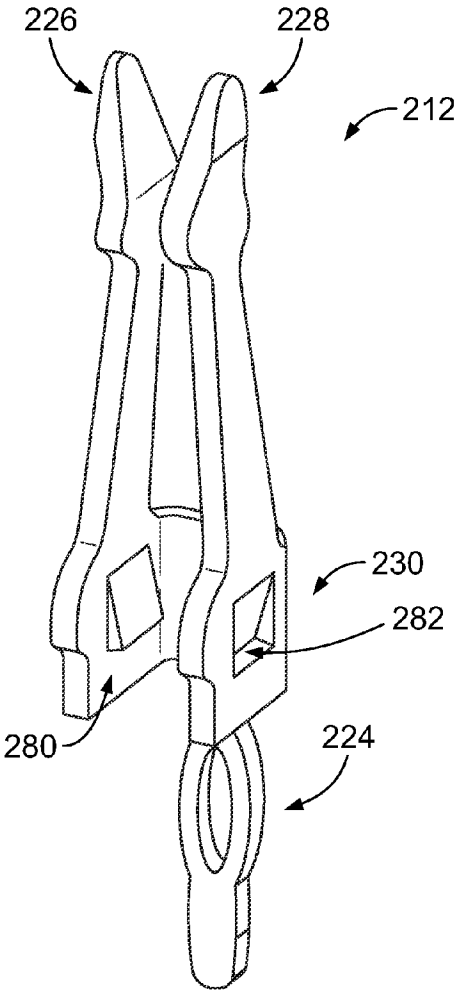
FIG. 10 is a perspective view of an electrical contact formed in accordance with one embodiment.
Figure 11:
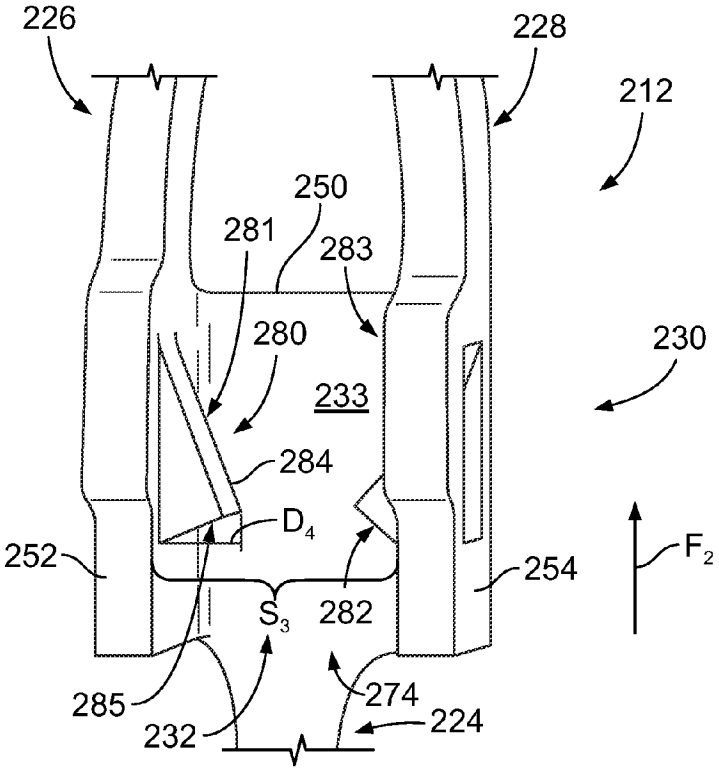
FIG. 11 is an enlarged perspective view of the electrical contact of FIG. 10.

FIGS. 10 and 11 illustrate an electrical contact 212 formed in accordance with one embodiment that may also be used with the electrical connector 100 (FIG. 1). The electrical contact 212 may have similar features as the electrical contact 112 (FIG. 2), such as a compliant tail 224, mating beams 226, 228, and a channel section 230. However, the channel section 230 may include flow-limiting features 280, 282 that are different than the flow-limiting features 180, 182 of FIG. 5.

FIG. 11 is an enlarged perspective view of the channel section 230 illustrating the flow-limiting features 280, 282 in greater detail. As shown, the channel section includes a base wall 250 and sidewalls 252, 254 that project away from the base wall 250. The sidewalls 252, 254 face each other across a flow channel 232 and have a spacing $S_3$ therebetween. The flow channel 232 is defined by a channel surface 233. The flow-limiting features 280, 282 constitute lanced portions 281, 283 of the sidewalls 252, 254. For example, when the electrical contact 212 is formed, the sidewalls 252, 254 may be pressed by a tool to form the lanced portions 281, 283. When the sheet material is pressed, projections 284 are formed that extend into the flow channel 232. The projections 284 (the projection 284 of the flow-limiting feature 282 is not shown) extend a distance $D_4$ into the flow channel 232. The projection 282 includes a feature surface 285 that faces in a direction toward an inlet 274 of the flow channel 232.

The projections 284 may function in a similar manner as the voids 181, 183 (FIG. 5) of the flow-limiting features 180, 182. More specifically, the projections 284 may be configured to disrupt a continuity of the channel surface 233 thereby impeding capillary flow of a plating solution to the mating beams 226, 228. The projections 284 may also operate to reduce a size of the spacing $S_3$ thereby impeding capillary flow of the plating solution through the flow channel 232.

The flow-limiting features 280, 282 can be located relative to the mating beams 226, 228 to facilitate impeding the plating solution from wetting the mating beams 226, 228. The flow-limiting features 280, 282 may be located with respect to the flow direction $F_2$ such that the plating solution flowing toward the mating beams 226, 228 would engage the flow-limiting features 280, 282. For example, the flow-limiting features 280, 282 may be substantially aligned with the mating beam 226, 228, respectively, in a similar manner as described above with respect to the flow-limiting features 180, 182.

Figure 12:
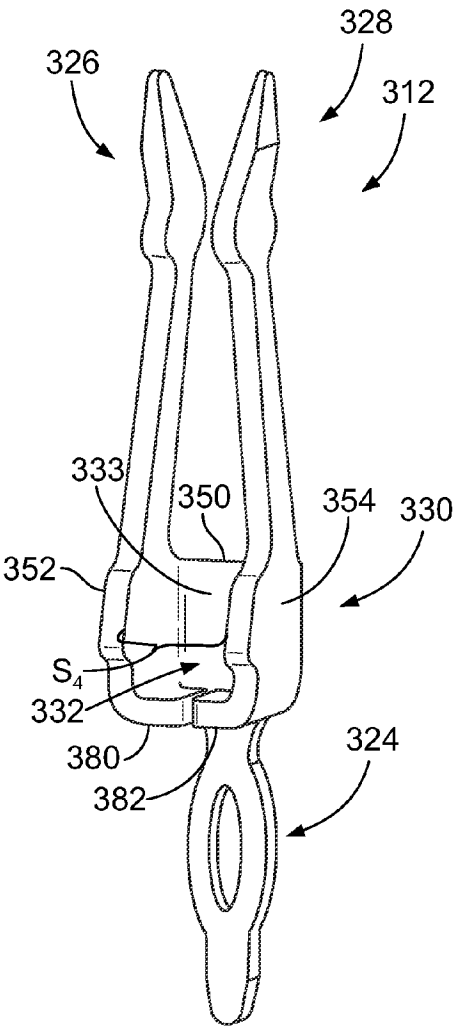
FIG. 12 is a perspective view of an electrical contact formed in accordance with one embodiment.
Figure 13:
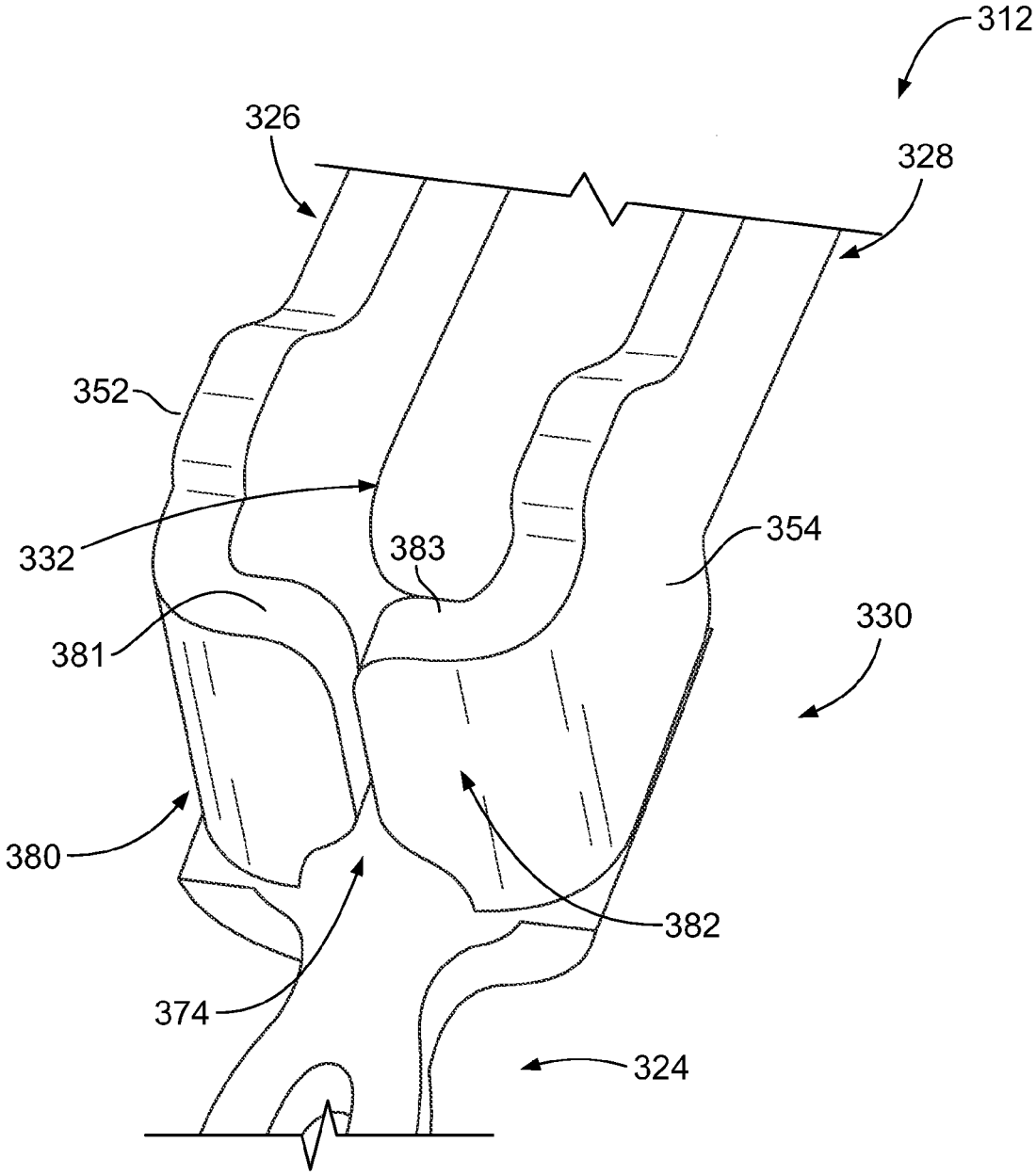
FIG. 13 is an enlarged perspective view of the electrical contact of FIG. 12.

FIGS. 12 and 13 illustrate an electrical contact 312 formed in accordance with one embodiment that may also be used with the electrical connector 100 (FIG. 1). As shown in FIG. 12, the electrical contact 312 may have similar features as the electrical contacts 112 and 212 described above, such as a compliant tail 324, mating beams 326, 328, and a channel section 330. However, the channel section 330 may include flow-limiting features 380, 382 that are different than the flow-limiting features 180, 182 (FIG. 1). The channel section 330 also includes a base wall 350 (FIG. 12) and sidewalls 352, 354 that project away from the base wall 350. The sidewalls 352, 354 face each other across a flow channel 332 and have a spacing $S_4$ (FIG. 12) therebetween. The flow channel 332 is defined by a channel surface 333.

FIG. 13 is an enlarged perspective view of the channel section 330 illustrating the flow-limiting features 380, 382 in greater detail. The flow-limiting features 380, 382 constitute folded tab portions 381, 383 that extend from the sidewalls 352, 354. The flow-limiting features 380, 382 are folded toward each other to limit access to the flow channel 332 from proximate the compliant tail 324. For example, when the electrical contact 312 is formed, the sidewalls 352, 354 may be folded with respect to the base wall 350 (FIG. 12), and the flow-limiting features 380, 382 may be folded toward each other. The flow-limiting features 380, 382 may at least partially cover an opening 374 into the flow channel 332. The flow-limiting features 380, 382 are configured to limit an amount of plating solution that enters the flow channel 332 thereby impeding capillary flow of the plating solution to the mating beams 326, 328.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact comprising an elongated contact body that includes a compliant tail, a mating beam, and a channel section extending between the compliant tail and the mating beam, the channel section having a base wall and sidewalls that extend from the base wall, the base wall and the sidewalls extending around a central longitudinal axis to define a flow channel of the channel section, the compliant tail extending from the base wall parallel to the longitudinal axis, the channel section having a channel surface and including a flow-limiting feature that is configured to impede capillary flow of a plating solution in a flow direction that is along the channel section from the compliant tail to the mating beam, wherein the flow-limiting feature is a structural feature that disrupts a continuity of the channel surface, the flow-limiting feature being located, sized, and shaped to impede the capillary flow of the plating solution in the flow direction onto the mating beam;

wherein the flow-limiting feature includes at least one of (a) a void that extends through one of the base wall or the sidewalls or (b) a projection that extends into the flow channel from one of the base wall or the sidewalls; and wherein the flow-limiting feature is aligned with a joint portion of the mating beam such that a line extending from the flow-limiting feature and substantially parallel to the longitudinal axis coincides with a centerline of the joint portion.

2. The electrical contact of claim 1, wherein the mating beam has a distal end, the joint portion joining the mating beam and one of the sidewalls of the channel section, the mating beam configured to flex about the joint portion.

3. The electrical contact of claim 1, wherein the line extends from a center of the flow-limiting feature and coincides with the centerline of the joint portion.

4. The electrical contact of claim 1, wherein the flow-limiting feature includes a lanced portion of the channel section that projects into the flow channel.

5. The electrical contact of claim 1, wherein the compliant tail is plated with a first material and the mating beam is plated with a different second material.

6. The electrical contact of claim 5, wherein the contact body is plated with a base material, the first and second materials being plated onto the base material.

7. The electrical contact of claim 5, wherein the first material includes tin or tin-lead and the second material includes gold or palladium-nickel.

8. The electrical contact of claim 1, wherein the mating beam is a first mating beam and the electrical contact further comprises a second mating beam, the first and second mating beams extending along the longitudinal axis and having distal mating areas.

9. The electrical contact of claim 8, wherein the first and second mating beams are spaced apart and are inclined toward each other.

10. The electrical contact of claim 1, wherein the flow-limiting feature is a first flow-limiting feature and the electrical contact further comprises a second flow-limiting feature.

11. The electrical contact of claim 1, wherein the flow-limiting feature is located in one of the sidewalls, the flow-limiting feature including a geometric center of the sidewall.

12. The electrical contact of claim 11, wherein the mating beam has a joint portion that joins the mating beam and said one of the sidewalls, wherein said one of the sidewalls is defined by the joint portion, the base wall, a wall edge of said one of the sidewalls that partially defines the inlet, and a wall edge of said one of the sidewalls that extends generally along the longitudinal axis.

13. An electrical connector comprising:

a connector housing having an array of contact cavities;

electrical contacts located in the contact cavities, at least a plurality of the electrical contacts including signal contacts, each of the plurality of signal contacts comprising an elongated contact body that includes a compliant tail, a mating beam, and a channel section extending between the compliant tail and the mating beam, the channel section having a base wall and sidewalls that extend from the base wall, the base wall and the sidewalls extending around a central longitudinal axis to define a flow channel of the channel section, the channel section having a channel surface and including a flow-limiting feature that is configured to impede capillary flow of a plating solution in a flow direction that is along the channel section from the compliant tail to the mating beam, wherein the flow-limiting feature is a structural feature that disrupts a continuity of the channel surface, the flow-limiting feature being located, sized, and shaped to impede the capillary flow of the plating solution in the flow direction onto the mating beam;

wherein the flow-limiting feature includes at least one of (a) a void that extends through one of the base wall or the sidewalls or (b) a projection that extends into the flow channel from one of the base wall or the sidewalls; and wherein the flow-limiting feature is aligned with the mating beam along the longitudinal axis such that a line extending from the flow-limiting feature and substantially parallel to the longitudinal axis coincides with a centerline of the mating beam.

14. The electrical connector of claim 13, wherein the mating beam has a joint portion and a distal end, the joint portion extending from the channel section, the flow-limiting feature being aligned with the joint portion of the mating beam.

15. The electrical connector of claim 13, wherein the flow-limiting feature is a first flow-limiting feature and the electrical contact further comprises a second flow-limiting feature.

16. An electrical contact comprising an elongated contact body that includes a compliant tail, a mating beam, and a channel section extending between the compliant tail and the mating beam, the channel section having a base wall and sidewalls that extend from the base wall, the base wall and the sidewalls extending around a central longitudinal axis to define a flow channel of the channel section, the compliant tail extending from the base wall parallel to the longitudinal axis, the channel section having a channel surface and including a flow-limiting feature that is configured to impede capillary flow of a plating solution in a flow direction that is along the channel section from the compliant tail to the mating beam, wherein the flow-limiting feature is aligned with the mating beam along the longitudinal axis such that a line extending from the flow-limiting feature and substantially parallel to the longitudinal axis coincides with a centerline of the mating beam; and wherein the flow-limiting feature includes at least one of (a) a void that extends through one of the base wall or the sidewalls or (b) a projection that extends into the flow channel from one of the base wall or the sidewalls.

17. The electrical contact of claim 16, wherein the line extends from a center of the flow-limiting feature and coincides with the centerline of the mating beam.

* * * * *